US009795226B2

(12) United States Patent
Goenka

(10) Patent No.: US 9,795,226 B2
(45) Date of Patent: Oct. 24, 2017

(54) ERGONOMIC MATTRESS PAD WITH POLYESTER FILL

(71) Applicant: WELSPUN INDIA LIMITED, Mumbai (IN)

(72) Inventor: Dipali Goenka, Mumbai (IN)

(73) Assignee: WELSPUN INDIA LIMITED, Mumbai (IN)

( * ) Notice: Subject to any disclaimer, the term of this patent is extended or adjusted under 35 U.S.C. 154(b) by 0 days.

(21) Appl. No.: 15/361,489

(22) Filed: Nov. 27, 2016

(65) Prior Publication Data

US 2017/0135496 A1 May 18, 2017

Related U.S. Application Data

(63) Continuation of application No. 14/859,812, filed on Sep. 21, 2015, now Pat. No. 9,504,334, which is a continuation of application No. 14/715,015, filed on May 18, 2015, now Pat. No. 9,138,066.

(30) Foreign Application Priority Data

May 19, 2014 (IN) ..... 1675/MUM/2014

(51) Int. Cl.

| | |
|---|---|
| ***A47C 27/00*** | (2006.01) |
| ***A47C 31/10*** | (2006.01) |
| ***A47C 27/12*** | (2006.01) |

(52) U.S. Cl.
CPC ..... *A47C 31/105* (2013.01); *A47C 27/121* (2013.01); *A47C 27/122* (2013.01)

(58) Field of Classification Search
CPC ..... A47C 27/00
USPC ..... 5/632, 727, 731, 733, 736
See application file for complete search history.

(56) References Cited

U.S. PATENT DOCUMENTS

| | | | | |
|---|---|---|---|---|
| 929,449 A * | 7/1909 | Klimowicz | ..... | A47C 27/121 5/727 |
| 4,688,283 A * | 8/1987 | Jacobson | ..... | A47C 27/081 5/709 |
| 4,922,564 A * | 5/1990 | Thomas | ..... | A47C 27/12 5/727 |

* cited by examiner

*Primary Examiner* — Fredrick Conley
(74) *Attorney, Agent, or Firm* — Tillman Wright, PLLC; Chad D. Tillman

(57) ABSTRACT

A mattress pad for supporting a human body includes an upper layer, a lower layer, and a wadding layer therebetween including three distinct zones arranged along the length of the pad for varying support of the human body; the first zone is configured to support a head portion and a neck portion; the second zone is configured to support an upper body portion and a lumbar portion; and the third zone is configured to support a lower back portion and leg portion wherein thickness and length in these zones varies for providing the varying support.

20 Claims, 3 Drawing Sheets

ERGONOMIC MATTRESS PAD WITH POLYESTER FILL

CROSS-REFERENCE TO RELATED APPLICATION

The present application is a U.S. continuation patent application of, and claims priority under 35 U.S.C. §120 to, U.S. nonprovisional patent application Ser. No. 14/859,812, filed Sep. 21, 2015, which '812 application is a U.S. continuation patent application of, and claims priority under 35 U.S.C. §120 to, U.S. nonprovisional patent application Ser. No. 14/715,015, filed May 18, 2015, which '015 application claims foreign priority under 35 U.S.C. §119 to Indian patent application 1675/MUM/2014 filed May 19, 2014, and which '015 application issued as U.S. Pat. No. 9,138,066 on Sep. 22, 2015, both of which patent applications and which patent are incorporated by reference herein. Furthermore, a copy of the disclosure of the Indian patent application is found in the Appendix, which is incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD OF THE INVENTION

The present invention generally relates to a mattress pad having multiple zones of comfort along its length. More specifically, preferred embodiments herein relate to a polyester fill mattress pad having distinct comfort zones, each particularly suited for supporting a particular portion of a human body.

BACKGROUND OF THE INVENTION

Conventionally a polyester filled mattress pad has three layers. The top and bottom layers are made up of fabric which may be manufactured using different textile materials including cotton, polyesters, silk, polypropylene or any other natural or manmade material. The middle layer is generally made up of polyester, or cotton, or blend of cotton, polyester, or goose feathers, or any other natural or manmade material. The middle layer is either blown filled (in case of lose fibers), or it is placed (in case of garnet fill) in between the top and bottom layers, whether placed mechanically, manually, or combination thereof. The three layers are sewn together on the edges and then all three layers are quilted together. The quilt design usually includes a geometric shape such as a box, a diamond, a hexagon, etc. FIGS. 1, 2, and 3 depict conventional mattress pads. The mattress pad 10 of FIG. 1 has a flat upper exterior surface with box quilting; the mattress pad 20 of FIG. 2 has a flat upper exterior surface with diamond quilting; and the mattress pad 30 of FIG. 3 has a flat upper exterior surface with invisible flat quilting.

Additionally, a knitted or woven or nonwoven fabric is attached on the edges of the quilted piece to form a drop of the mattress pad. The purpose of the drop is to make the mattress pad fit properly on a mattress.

It is believed that a drawback to such a mattress pad having a flat quilted surface is the resulting lack of support that is provided at various regions of the body, which support is required for better sleep and relaxation. In particular, the flat quilted surface of these mattress pads results in a lack of support at the various regions of the body believed to be required for better sleep and relaxation.

Indeed, the mass and distribution of a human body varies widely from head to toe, which places substantially more pressure on a mattress in areas such as the pelvic and shoulder regions than in other regions. As evidence of this, over a period of time the structure of a mattress compresses noticeably to a greater extent in the pelvic and shoulder regions than the other areas of the mattress. Further, it is believed that these compressed regions induce pain and aches in different regions of the human body. Usage of such a mattress ultimately leads to discomfort in sleep and frequent tossing and turning on a bed. Use of a mattress pad having a flat quilted surface does not help in this respect.

As an alternative consumers sometimes purchase body contour mattress pads or mattresses, which are either made of memory foam or latex, and that are quite expensive. The body contour mattress pad helps in providing support to the entire body at the major areas when used on a mattress, but since these mattress pads are made from latex or memory foam, such mattress pads are bulky, are not so easy to handle, and are not washable. Further, such mattress pads also heat up quickly during usage and tend to have a displeasing odor.

In view of the foregoing, it is believed that a need exists for a mattress pad that has multiple comfort zones along its length for supporting the human body and facilitating faster relaxation of the human body to induce better sleep, and that overcomes the aforementioned disadvantages of a body contoured mattress pad made of memory foam or latex. Such a need is believed to be addressed by at least some embodiments of the invention.

SUMMARY OF THE INVENTION

The present invention includes many aspects and features. In a first aspect, a mattress pad has multiple zones located along its length for varying support of a human body on top of the mattress pad, wherein the multiple zones are defined by wadding and quilting patterns of the mattress pad In another aspect of the invention, a mattress pad includes an upper layer defining an exterior surface on a top side of the mattress pad, a lower layer defining an exterior surface on a side of the mattress pad opposite the top side, and a wadding layer comprising wadding located between said upper layer and said lower layer. In accordance with this aspect, the upper layer, the lower layer, and the wadding layer are quilted together and define a plurality of support zones for supporting a human body on the top of the mattress pad. Furthermore, the plurality of support zones includes: a first support zone comprising a quilted head region for supporting a head portion of a human body, and a non-quilted neck region for supporting a neck portion of a human body; and a second support zone comprising a quilted upper body region for supporting an upper body portion of a human body, and a non-quilted lumbar region for supporting a lumbar portion of a human body. The quilted head region has a thickness that is different from the thickness of the non-quilted neck region, the difference in thickness resulting from at least one of a variance in an amount of the wadding used in each of the quilted head region and the non-quilted neck region and a variance in quilting applied in each of the quilted head region and the non-quilted neck region; and the quilted upper body region has a thickness that is different from the thickness of the non-quilted lumbar region, the difference in thickness resulting from at least one of a variance in an amount of the wadding used in each of the quilted upper body region and the non-quilted lumbar region, and a variance in quilting applied in each of the quilted upper body region and the non-quilted lumbar region.

In a feature, each said region extends the width of the top side of the mattress pad.

In a feature, the quilted head region has a quilting pattern applied therein that demarcates the quilted head region and that is different from a quilting pattern that is applied in the quilted upper body region and that demarcates the quilted upper body region. For instance, the quilting pattern applied in the quilted upper body region may comprise a matrix of irregular polygons comprising rectangles, and the quilting pattern applied in the head region may comprise a matrix of regular polygons comprising squares.

In a feature, the non-quilted regions each protrude on the top side of the mattress pad to a greater extent than each of the quilted regions.

In a feature, the non-quilted lumbar region protrudes on the top side of the mattress pad to a greater extent than the non-quilted neck region.

In a feature, the quilted head region protrudes an extent between one-half inch and one inch; wherein the non-quilted neck region protrudes an extent between one inch and two inches; and wherein the lumbar region protrudes an extent between two inches and five inches.

In a feature, the non-quilted lumbar region has a greater lengthwise extent than a lengthwise extent of the non-quilted neck region.

In a feature, the quilted head region has a greater lengthwise extent than a lengthwise extent of the non-quilted neck region.

In a feature, the quilted upper body region has a greater lengthwise extent than a lengthwise extent of the non-quilted lumbar region.

In a feature, the quilted upper body region has a greater lengthwise extent than a lengthwise extent of the quilted head region.

In a feature, the non-quilted lumbar region has a greater lengthwise extent than a lengthwise extent of the non-quilted neck region.

In a feature, the quilted head region has a lengthwise extent between six inches and ten inches; wherein the neck region has a lengthwise extent between six inches and eight inches; wherein the upper body region has a lengthwise extent between eight inches and fourteen inches; and wherein the lumbar region has a lengthwise extent between ten inches and fifteen inches.

In additional features, the plurality of the support zones of the mattress pad further comprises a third support zone comprising a quilted lower back region for supporting a lower back portion of a human body and having a first quilting pattern applied therein demarcating the quilted lower back region, and a quilted leg region for supporting a leg portion of a human body and having a second quilting pattern applied therein demarcating the quilted leg region that is different from the first quilting pattern applied in and demarcating the quilted lower back region. The quilted leg portion preferably has a greater lengthwise extent than a lengthwise extent of the lower back region. For example, the lower back portion region may have a lengthwise extent between eight inches and ten inches, and the leg region may have a lengthwise extent between twenty inches and forty inches. Additionally, the first quilting pattern applied in the quilted lower back region may comprise a matrix of irregular polygons comprising rectangles, and the second quilting pattern applied in the quilted leg region may comprise parallel lines extending a lengthwise direction of the top side of the mattress pad. Also, the first, second, and third support zones collectively extend the length of the top side of the mattress pad. Moreover, the quilted head region may have a quilting pattern applied therein that is different from a quilting pattern that is applied in the quilted upper body region, the quilting pattern that is applied in the quilted head region may be different from the quilting pattern that is applied in the quilted leg region, the quilting pattern that is applied in the quilted upper body region may be different from the quilting pattern that is applied in the quilted leg region, and the quilting pattern that is applied in the quilted upper body region may be the same as the quilting pattern that is applied in the quilted lower back region.

In a feature, the mattress pad further includes a drop for fitting the mattress pad on top of a mattress.

In a feature, the wadding in at least one region of a support zone has a density that is different from the density of the wadding in another region of a support zone.

In a feature, at least one of the upper layer and the lower layer comprises a nonwoven material.

In a feature, at least one of the upper layer and the lower layer a woven material.

In a feature, at least one of the upper layer and the lower layer comprises a knitted material.

In a feature, at least one of the upper layer and the lower layer comprises a material made from cotton, polyester, silk, or polypropylene.

In a feature, the wadding layer comprises loose fibers.

In a feature, the wadding layer comprises garneted fibers.

In another aspect, a method of making a mattress pad having a plurality of support zones for supporting the human body includes the steps of: quilting together an upper layer, a lower layer, and a wadding layer comprising wadding located between the upper layer and the lower layer such that the upper layer defines an exterior surface on a top side of the mattress pad and the lower layer defines an exterior surface on a side of the mattress pad opposite the top side, and such that a plurality of support zones are defined in the mattress pad for varying support of different portions of a human body on the top of the mattress pad. This is done by varying the filling and quilting of the mattress pad in defining the plurality of support zones such that first and second support zones are defined, wherein the first support zone comprises a quilted head region for supporting a head portion of a human body and a non-quilted neck region for supporting a neck portion of a human body; and wherein the second support zone comprises a quilted upper body region for supporting an upper body portion of a human body, and a non-quilted lumbar region for supporting a lumbar portion of a human body. Furthermore, the quilted head region that is defined has a thickness that is different from the thickness of the non-quilted neck region, the difference in thickness resulting from at least one of a variance in an amount of the wadding used in each of the quilted head region and the non-quilted neck region and a variance in quilting applied in each of the quilted head region and the non-quilted neck region; and the quilted upper body region that is defined has a thickness that is different from the thickness of the non-quilted lumbar region, the difference in thickness resulting from at least one of a variance in an amount of the wadding used in each of the quilted upper body region and the non-quilted lumbar region, and a variance in quilting applied in each of the quilted upper body region and the non-quilted lumbar region.

In another aspect, a method for improving quality of sleep of a person includes the steps of: providing a mattress pad in accordance with one or more aspects and features of the invention; and lying on the mattress such that the head is supported on the mattress pad in a quilted head region, the neck is supported on the mattress pad in a non-quilted neck region, the upper body is supported on the mattress pad in a quilted upper body region, and the lumbar is supported on the mattress pad in a non-quilted lumbar region.

In a feature, the method further includes using a pillow in supporting the head on the mattress pad in the quilted head region.

In a preferred embodiment, a mattress pad for supporting human body comprises an upper layer, a lower layer, and a wadding layer disposed between the upper layer and the lower layer. The wadding layer includes three distinct comfort zones arranged along the length of the mattress pad. The first zone is configured to support a head portion and a neck portion of the human body, the second zone is configured to support an upper body portion and a lumbar portion of the human body, and third zone is formed to support lower back and a leg portion of the human body. Thickness and length of the wadding layer varies with respect to the specific zones. Further, at least two zones in the mattress each includes a quilted region and a non-quilted region having different thicknesses therebetween.

Additional aspects and features are disclosed in the Appendix, which is incorporated herein by reference.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the invention now will be described in detail with reference to the accompanying drawings, wherein the same elements are referred to with the same reference numerals.

DETAILED DESCRIPTION

Figure 1:
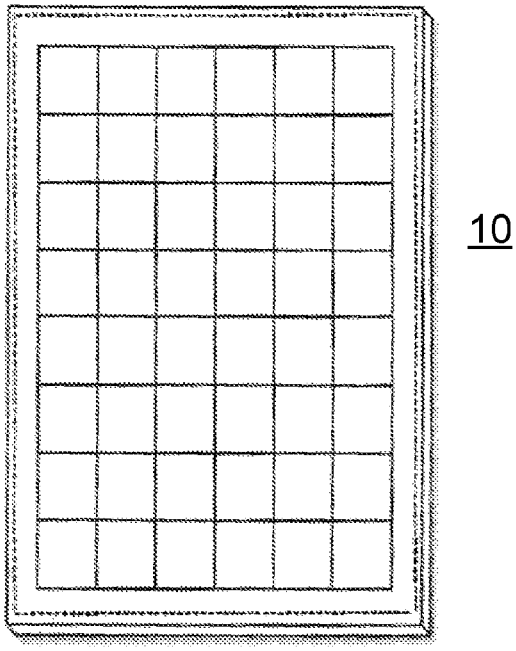
(Prior Art) FIG. 1
FIG. 1 illustrates a schematic top view of conventional mattress pad having a flat surface with box quilting.
Figure 2:
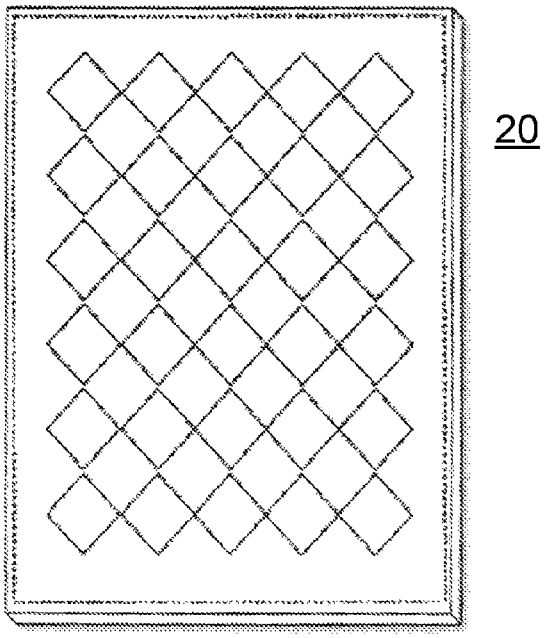
(Prior Art) FIG. 2
FIG. 2 illustrates a schematic top view of conventional mattress pad having a flat surface with diamond quilting.
Figure 3:
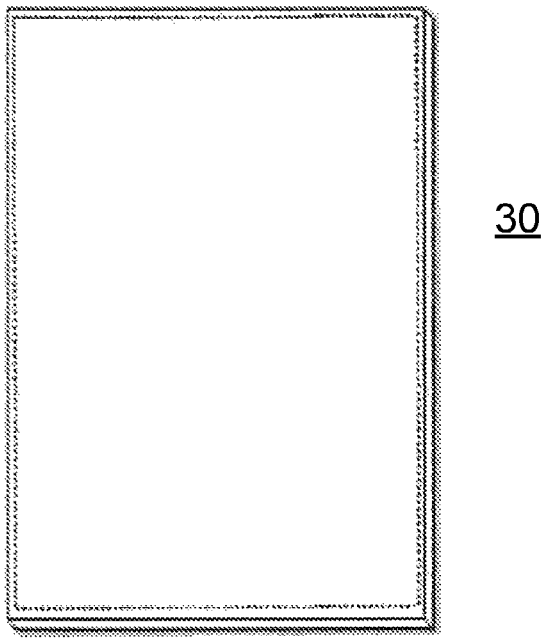
(Prior Art) FIG. 3
FIG. 3 illustrates schematic top view of a conventional mattress pad having invisible flat quilting.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention, and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. 112, paragraph 6 or subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples". In contrast, reference to "a picnic basket having a single apple" describes "a picnic basket having only one apple".

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers". When used herein to join a list of items, "and" denotes "all of the items of the list". Thus, reference to "a picnic basket having cheese and crackers" describes "a picnic basket having cheese, wherein the picnic basket further has crackers," as well as describes "a picnic basket having crackers, wherein the picnic basket further has cheese".

Additionally, as used herein, "thickness" with respect to a region of a support zone refers to a contour of such region—including size and profile thereof—when nothing is supported on the mattress pad when the mattress pad is positioned for use. Indeed, the varying thicknesses of the regions is perhaps best seen and understood with reference to FIG. 5, which schematically illustrates a side of the mattress pad of FIG. 4, including each region's profile and relative sizes.

Referring now to the drawings, one or more preferred embodiments of the invention are next described. The following description of one or more preferred embodiments is merely exemplary in nature and is in no way intended to limit the invention, its implementations, or uses.

Figure 4:
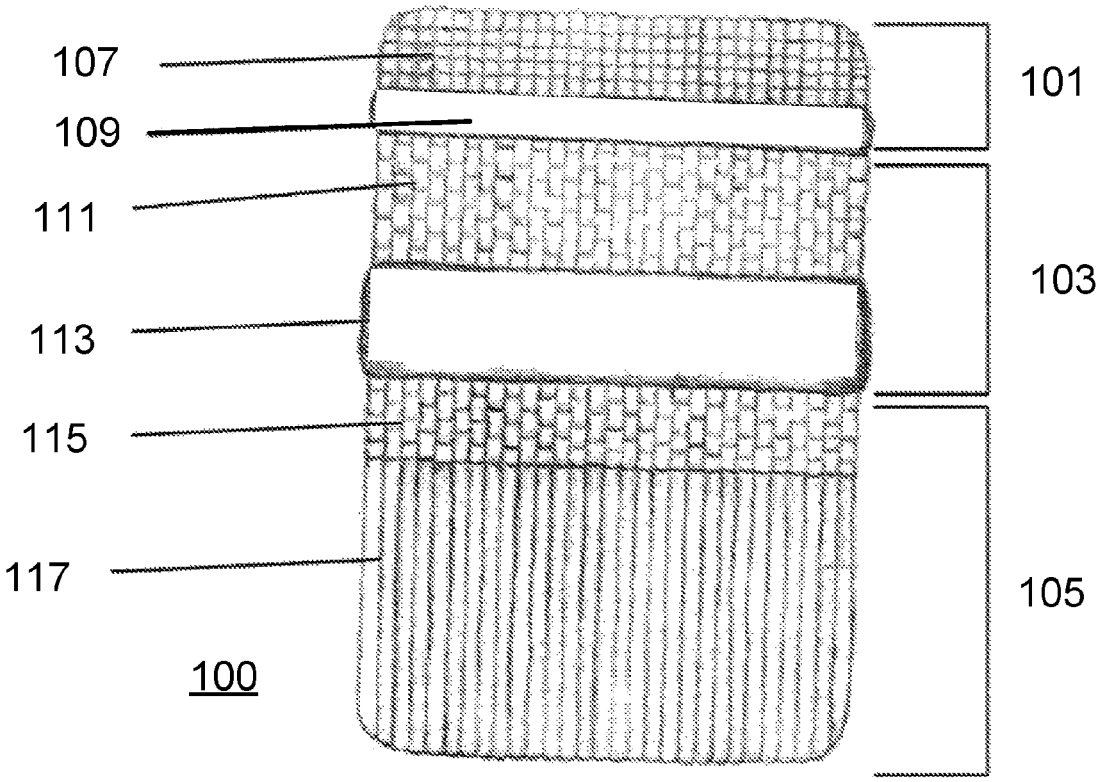
FIG. 4 illustrates a schematic top view of an ergonomic mattress pad with the differential fill and quilting in accordance with a preferred embodiment of the invention.
Figure 5:
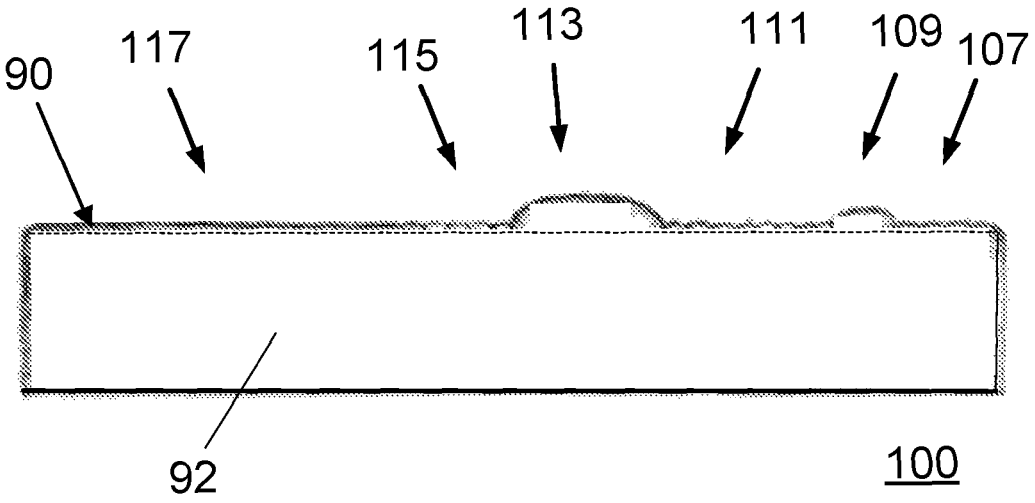
FIG. 5 illustrates a schematic side view of the ergonomic mattress pad of FIG. 4A.

FIGS. 4 and 5 illustrate an ergonomic mattress pad 100 in accordance with a preferred embodiment of the invention. The mattress pad 100 comprises an upper layer 90, a lower layer, and a wadding layer located between the upper layer and the lower layer. All three layers are quilted together to form one single nonwoven/woven/knitted textile material quilt cake 90. The quilted cake thus obtained is then attached with a knitted/woven or nonwoven drop 92 to complete the mattress pad 100.

The upper and lower layers are made up of nonwoven/woven/knitted textile material, which may be manufactured using different textile materials including cotton, polyesters, silk, polypropylene, or any other natural or manmade material. The wadding layer is made up of different fill weights. For example, loose fibers are filled in case of blown fill, and garneted fibers are filled in case of manual/mechanical fill. Furthermore, while polyester fill is preferred, any natural or synthetic fill can be used as desired, including for example polyester, lyocell, tencel, cotton, and wool.

In accordance with one or more aspects and features of the invention, the filling and quilting is done in such a way that different support zones are created in the mattress pad, each zone having one or more quilt patterns and one or more different elevations (i.e., thicknesses). The differences in the support zones preferably are achieved by a combination of the quantity or amount of wadding (filled material) of various densities (grams per square meters) utilized in each zone; and the quilting applied in each region of each zone. Polyester fibers are used for wadding in one or more preferred embodiments.

For example, the mattress pad 100 preferably includes a plurality of defined support zones as shown in FIGS. 4 and 5, including a first support zone 101 having a predetermined thickness and length of wadding, and being defined by a quilted region 107 for supporting a head portion of a human body and a non-quilted region 109 for supporting a neck portion of a human body; a second support zone 103 having a predetermined thickness and length of wadding, and being defined by a quilted region 111 for supporting an upper body portion of a human body and a non-quilted region 113 for supporting a lumbar portion of a human body; and a third support zone 105 having a predetermined thickness and length of wadding, and being defined by a quilted region 115 for supporting a lower back portion of a human body and another quilted region 117 for supporting a leg portion of a human body. Moreover, the quilted regions in this third support zone 105 each preferably has a different quilt pattern.

As illustrated in FIG. 4, the three support zones 101,103, 105 generally extend the length and the width of the top of the mattress pad 100, with the aforementioned regions 107,109; regions 111,113; and regions 115,117 defining their respective support zones 101,103,105. Furthermore, the same or similar quilt pattern can be utilized in a region of two or more support zones; the quilt pattern of region 111 is schematically shown in FIG. 4 to be the same as that of region 115. In particular, the quilt pattern of region 107 represents a square matrix pattern; the quilt pattern of region 111 represents a rectangular matrix pattern; the quilt pattern of region 115 represents the rectangular matrix pattern of region 111; and the quilt pattern of region 117 represents a pattern of parallel, elongate strip sections, each section extending the length of the region 117.

In certain preferred embodiments, the thickness of the region 107 for supporting the head is within a range of one-half inch to one inch; the thickness of the region 109 for supporting the neck portion is within a range of one inch to two inches; and the thickness of the region 115 for supporting the lower back portion 115 is within a range of two inches to five inches.

Additionally, in certain preferred embodiments, the length of the region 107 for supporting the head is within a range of six inches to ten inches; the length of the region 109 for supporting then neck preferably is within a range of six inches to eight inches; the length of the region 111 for supporting the upper body portion is within a range of eight inches to fourteen inches; the length of the region 113 for supporting the lumbar portion is within a range of ten inches to fifteen inches; the length of the region 115 for supporting the lower back portion is within a range of eight inches to ten inches; and the length of the region 117 for supporting the leg portion is within a range of twenty inches to forty inches.

In preferred embodiments, the different support zones of the mattress pad are designed intelligently to provide maximum support to the human body, especially at the lumbar and neck portions of the human body. It is believed that such support of these portions facilitates relaxing of the human body at a faster rate, thereby resulting in better comfort and inducing better sleep, and consequently resulting in increased sleep efficiency and a higher level of restorative sleep.

It will further be appreciated that a mattress pad may be made of soft support or firm support based on the need for such support by changing poly or poly blended material with a natural/manmade fiber wadding; and it will be appreciated that the thickness and length of wadding, and the pattern of quilt, can be varied in each region and zone based on the height and weight of the user.

Testing

A test including qualitative and quantitative electromyograms (EMGs) was conducted using (a) a conventional mattress pad compared with (b) an ergonomic mattress pad representing a preferred embodiment of the invention, which is referred to below as the "test mattress pad". As will be appreciated, an electromyogram is used for evaluating and recording electrical activity produced in muscles of the human body. The systems used included ALICE_5 and C2 I-330 systems with Physiolab software. The test included ten participants comprising five males and five females ranging in age from 18 years to 50 years. The total time of recording per participant was 30 minutes.

During the test, multiple electrodes initially were placed at different parts of the body of each subject, for example, three at the lower back, two at the neck portion, and one at the hand of the subject. The electrodes are attached to the skin of the subject using an adhesive. In a first phase, each subject with the attached electrodes was made to lie down flat on a conventional mattress pad without a pillow, and a first EMG result was recorded. For a second phase, each subject then was given a pillow while lying on the conventional mattress pad, and a second EMG result was recorded. In a third phase, each subject next was made to lie down on the test mattress pad without a pillow, and a third EMG result was recorded. In a fourth phase, each subject was given a pillow while lying on the test mattress pad and a fourth EMG result was recorded. Test results were compiled to indicate the comparison between the conventional mattress pad and the test mattress pad.

It is believed that the test results generally indicate a reduction of muscle tension in the lower back when a pillow is used with the test mattress pad as opposed to a pillow with a convention mattress pad. In this regard, FIG. 6 of the priority Indian patent application incorporated herein by reference and found in the Appendix hereto illustrates a graph showing the test results between the conventional mattress pad and the ergonomic mattress pad without using a pillow; and FIG. 7 of the priority Indian patent application incorporated herein by reference and found in the Appendix hereto illustrates a graph showing the test results between the conventional mattress pad and the ergonomic mattress pad using a pillow. Both the graphs show a series of lines which are thicker and thinner at a given instant time interval. The thicker lines in the graph indicate higher muscle tension while thinner line indicates lower muscle tension. Higher muscle tension is believed to lead to a lower sleep efficiency. Thus from these graphs, it can be inferred that using the test mattress pad with a pillow results in a reduction of muscle tension in the lower back, thereby providing a better sleep quality.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A mattress pad, comprising (a) an upper layer defining a first exterior surface on a first side of the mattress pad, a lower layer defining a second exterior surface on a second side of the mattress pad opposite the first side, and a wadding layer comprising wadding located between the upper layer and the lower layer;

(b) wherein the upper layer, the lower layer, and the wadding layer are quilted together to form a quilt cake having a plurality of regions for supporting a human body on the first side of the mattress pad;

(c) wherein the plurality of regions comprises, (i) a head region for supporting a head portion of a human body, (ii) a neck region for supporting a neck portion of a human body, (iii) an upper body region for supporting an upper body portion of a human body, and (iv) a lumbar region for supporting a lumbar portion of a human body;

(d) wherein the head region has a thickness that is different from a thickness of the upper body region, the difference in thickness resulting at least in part from a variance in an amount of the wadding that is in each of the head region and the upper body region; and (e) wherein each of the neck region and the lumbar region has no quilting pattern applied therein and each has a thickness that is greater than each of the thickness of the head region and the different thickness of the upper body region.

2. The mattress pad of claim 1, wherein each of the plurality of regions extends the width of the first side of the mattress pad.

3. The mattress pad of claim 1, further comprising a drop extending from the first side of the mattress pad for fitting the mattress pad on top of a mattress.

4. The mattress pad of claim 1, wherein a quilting pattern is applied in the upper body region that demarcates the upper body region, and wherein a quilting pattern is applied in the head region that demarcates the head region.

5. The mattress pad of claim 1, wherein the lumbar region has a greater lengthwise extent than a lengthwise extent of the neck region.

6. The mattress pad of claim 1, wherein the head region has a greater lengthwise extent than a lengthwise extent of the neck region.

7. The mattress pad of claim 1, wherein the upper body region has a greater lengthwise extent than a lengthwise extent of the lumbar region.

8. The mattress pad of claim 1, wherein the upper body region has a greater lengthwise extent than a lengthwise extent of the head region.

9. The mattress pad of claim 1, wherein the lumbar region has a greater lengthwise extent than a lengthwise extent of the neck region.

10. The method of claim 1, wherein the thickness of the head region is different from the thickness of the upper body region at least in part from a variance in a density of the wadding in each of the head region and the upper body region.

11. The mattress pad of claim 1, wherein the plurality of the regions of the mattress pad further comprises a lower back region for supporting a lower back portion of a human body, and a leg region for supporting a leg portion of a human body.

12. The mattress pad of claim 11, wherein the leg region has a greater lengthwise extent than a lengthwise extent of the lower back region.

13. The mattress pad of claim 11, wherein each of the plurality of regions extends the width of the first side of the mattress pad.

14. The mattress pad of claim 11, wherein the head region, the neck region, the upper body region, the lumbar region, the lower back region, and the leg region collectively extend the length of the first side of the mattress pad.

15. The mattress pad of claim 11, wherein the lower back region has a quilting pattern that is applied therein that demarcates the lower back region, and wherein the leg region has a quilting pattern that is applied therein that is different from the quilting pattern applied in the lower back region and that demarcates the leg region.

16. The mattress pad of claim 15, wherein the upper body region has a quilting pattern that is applied therein that is the same as the quilting pattern that is applied in the lower back region.

17. A method of making a mattress pad having a plurality of regions for supporting the human body, comprising quilting together an upper layer, a lower layer, and a wadding layer to form a quilt cake with the upper layer defining a first surface on a first side of the mattress pad and the lower layer defining a second surface on a second side of the mattress pad opposite the first side, wherein a plurality of regions are defined in the mattress pad for varying support of different portions of a human body when laying on the mattress pad including a head region that is defined for supporting a head portion of a human body, a neck region that is defined for supporting a neck portion of a human body, an upper body region that is defined for supporting an upper body portion of a human body, a lumbar region that is defined for supporting a lumbar portion of a human body, a lower back region that is defined for supporting a lower back portion of a human body, and a leg region that is defined for supporting a leg portion of a human body, wherein the head region has a thickness that is different from a thickness of the upper body region, the difference in thickness resulting at least in part from the variance in an amount of wadding that is applied in each of the head region and the upper body region; wherein each of the neck region and the lumbar region has no quilting pattern applied therein and each has a thickness that is greater than each of the thickness of the head region and the different thickness of the upper body region; wherein the lower back region has a quilting pattern applied therein that is the same as the quilting pattern applied in the upper body region; and wherein the leg region has a quilting pattern applied therein that is different from the quilting pattern in the lower back region.

18. The method of claim 17, wherein the thickness of the head region is different from the thickness of the upper body region at least in part from a variance in a density of the wadding in each of the head region and the upper body region.

19. A method of providing a mattress for improving quality of sleep of a person, comprising the steps of:

(a) providing a mattress pad comprising an upper layer defining a first exterior surface on a first side of the mattress pad, a lower layer defining a second exterior surface on a second side of the mattress pad opposite the first side, and a wadding layer comprising wadding located between the upper layer and the lower layer, wherein the upper layer, the lower layer, and the wadding layer are quilted together to form a quilt cake having a plurality of regions for supporting a human body on the first side of the mattress pad, including a first region, a second region, a third region, and a fourth region, wherein the first region has a thickness that is different from a thickness of the third region, the difference in thickness resulting at least in part from a variance in an amount of the wadding that is in each of the first region and the third region, and wherein each of the second region and the fourth region has no quilting applied therein and each has a thickness that is greater than each of the thickness of the first region and the different thickness of the third region; and (b) attaching the mattress pad to the mattress such that the first region is located on the mattress for supporting a head portion of a human body when laying on the mattress pad, the second region is located on the mattress for supporting a neck portion of a human body when laying on the mattress pad, the third region is located on the mattress for supporting an upper body portion of a human body when laying on the mattress pad, and the fourth region is located on the mattress for supporting a lumbar portion of a human body when laying on the mattress pad.

20. The method of claim 19, wherein the thickness of the first region is different from the thickness of the third region at least in part from a variance in a density of the wadding in each of the first region and the third region.

* * * * *